US006062414A

United States Patent [19]

Mongarli et al.

[11] Patent Number: 6,062,414

[45] Date of Patent: May 16, 2000

[54] CONTAINER, PARTICULARLY FOR DRINKS

[75] Inventors: Cesare Mongarli, Via Murialdo 7, I-10091 Alpignano; Alessandro Mongarli, Alpignano, both of Italy

[73] Assignee: Cesare Mongarli, Alpignano, Italy

[21] Appl. No.: 09/029,898

[22] PCT Filed: Sep. 9, 1996

[86] PCT No.: PCT/EP96/03943

§ 371 Date: May 8, 1998

§ 102(e) Date: May 8, 1998

[87] PCT Pub. No.: WO97/10150

PCT Pub. Date: Mar. 20, 1997

[30] Foreign Application Priority Data

Sep. 11, 1995 [IT] Italy ..... T095A0725

[51] Int. Cl.[7] ..... B65D 17/34

[52] U.S. Cl. ..... 220/269; 220/375; 220/906

[58] Field of Search ..... 220/269, 270, 220/831, 832, 375, 379, 906

[56] References Cited

U.S. PATENT DOCUMENTS

| | | | |
|---|---|---|---|
| 3,730,380 | 5/1973 | Silver . | |
| 3,847,300 | 11/1974 | Waters . | |
| 4,039,100 | 8/1977 | Wells | 220/269 |
| 4,203,528 | 5/1980 | Hasegawa . | |
| 4,207,991 | 6/1980 | Amabili | 220/269 |
| 4,231,487 | 11/1980 | Hasegawa . | |
| 4,253,582 | 3/1981 | Shields | 220/269 |
| 4,325,490 | 4/1982 | Conrad | 220/269 |
| 4,339,053 | 7/1982 | Tarro | 220/269 |
| 4,687,116 | 8/1987 | Dutt et al. . | |
| 5,411,159 | 5/1995 | Fan | 220/269 |

*Primary Examiner*—Nathan J. Newhouse
*Attorney, Agent, or Firm*—Sughrue, Mion, Zinn, Macpeak & Seas, PLLC

[57] ABSTRACT

A container, particularly for drinks, comprising an end (5) in which a closed line of weakening (6) is formed defining the outline of a lid (7) and of a corresponding hole (8), and a lever (10) associated with the lid (7) and operable manually in order to tear the wall (5) along the line of weakening (6) and remove the lid (7) from the container wall is characterized in that it comprises a flexible tongue (9) which normally bears on the outer face of the end wall (5) and has one end (9*a*) fixed to the lever (10) and to the lid (7) and the other end (9*b*) fixed to the outer face of the end wall of the container, spaced from the lid, the tongue (9) being able, as a result of the manual removal of the lid from the container wall, to adopt 2 a bent configuration in which the associated lid is in a position of disengagement from the hole (8), restraining means (15; 19, 20) being provided for keeping the tongue in the bent configuration.

6 Claims, 6 Drawing Sheets

CONTAINER, PARTICULARLY FOR DRINKS

Figure 2:
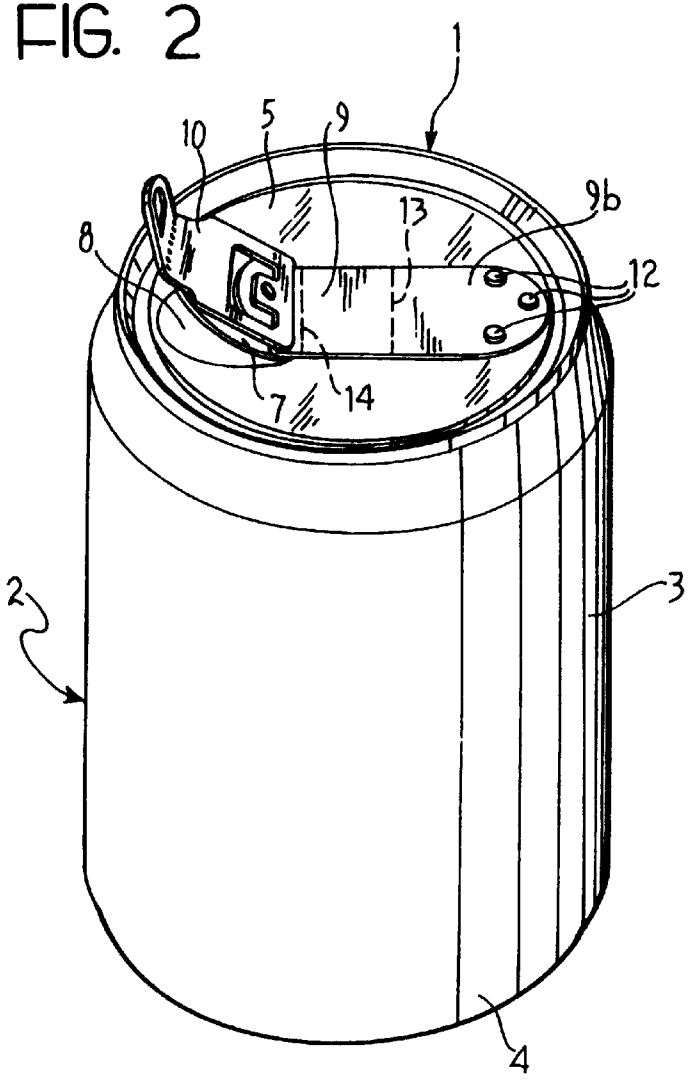

The present invention relates to a container, particularly to a container for drinks, of the type commonly known by the term "can".

More specifically, the invention relates to a container of the type comprising an end wall in which a closed line of weakening is formed defining the outline of a lid and of a corresponding hole, and a lever associated with the lid and operable manually in order to tear the wall along the line of weakening and to remove the lid from the container wall.

A known container of this type has the disadvantage that, when it is opened, the lever and the lid associated therewith are physically separated from the container and they can therefore be scattered in the environment.

To prevent this problem, drinks containers of the type defined at the beginning of the present description have been proposed, in which the line of weakening defining the outline of the lid is open and in which the operation of the lever tears the cover of the container and deflects the lid towards the inside of the container through the corresponding hole. After the lid has been torn and deflected, it remains firmly connected to the container and cannot be scattered separately in the environment. This solution has the disadvantage, however, that, as a result of the opening of the container, the lid is "dipped" into the drink with a consequent risk of contamination which renders ineffectual the precautions which are adopted in the production and packaging of the drink and which should ensure the sterility of the product.

U.S. Pat. No. 4,231,487 shows a container having the features contained in the pre-characterising portion of claim 1. This document discloses a pull tab for removing a panel portion of an easy opening container and thereafter effecting the folding up of the removed portion in a bent configuration. The tab is formed of plastics material which is so moulded so as to have a memory in the form of a plurality of transversely extending fold lines. The memory fold lines are operable progressively to roll up the tab in pup tent style to assume a triangular cross section.

This solution is complex and difficult to use on an industrial scale because also the lever and the removable panel portion must be provided with transverse fold lines in alignment with the memory fold lines so as to be folded up together and within the tab.

U.S. Pat. No. 4,203,528 teaches an alternative solution wherein a pull strip has hinge sections with a memory arranged so that, in the open configuration of the container, the removable panel portion is automatically swung to a position radially beyond the lateral wall of the container.

The disadvantage of the latter solution is that in the open configuration the removable portion is in a very exposed position and can hurt the user with its sharp edges.

The object of the present invention is to provide a container which overcome the disadvantages of the known solutions and having a simpler and less expensive structure.

According to the present invention this object is achieved by a container according to claim 1.

Figure 4:
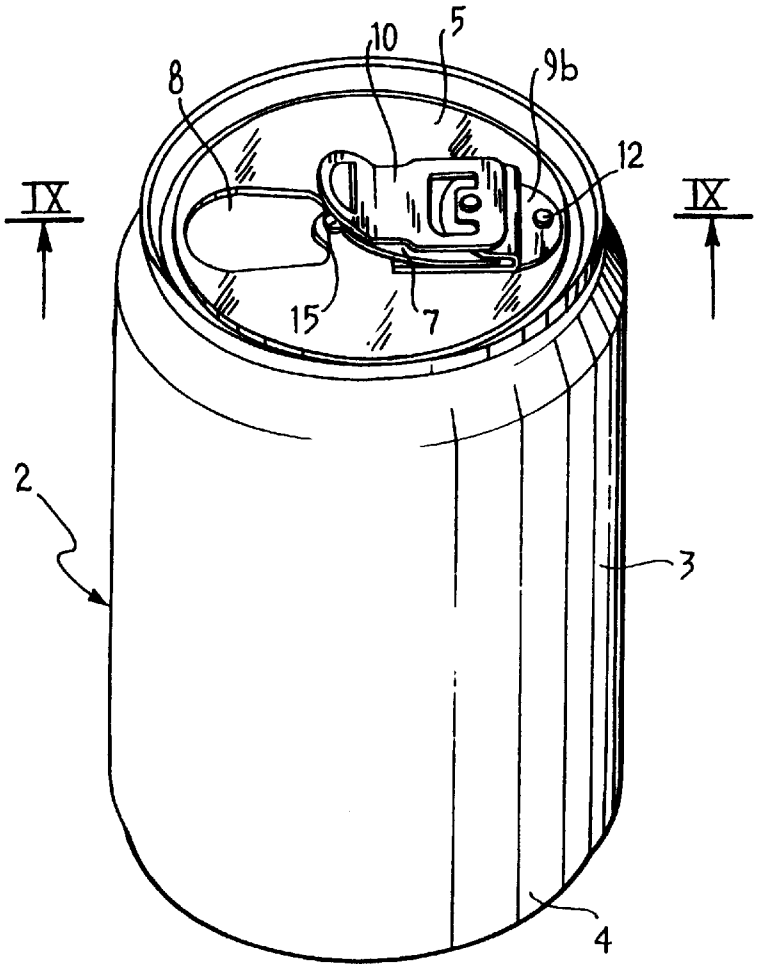
Figure 3:
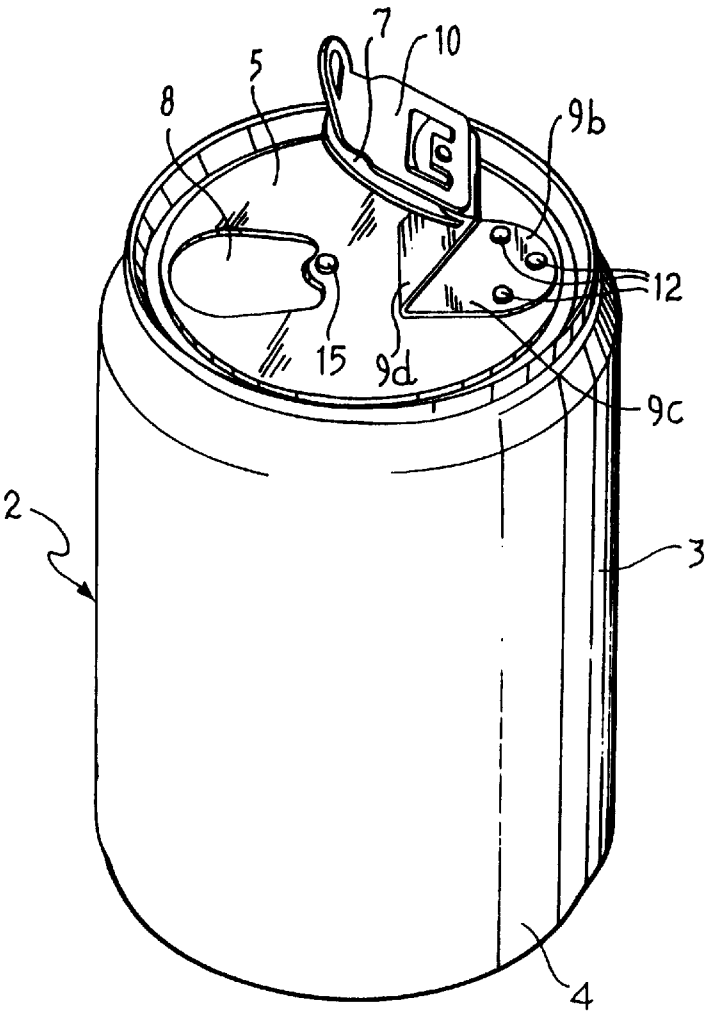
Figure 6:
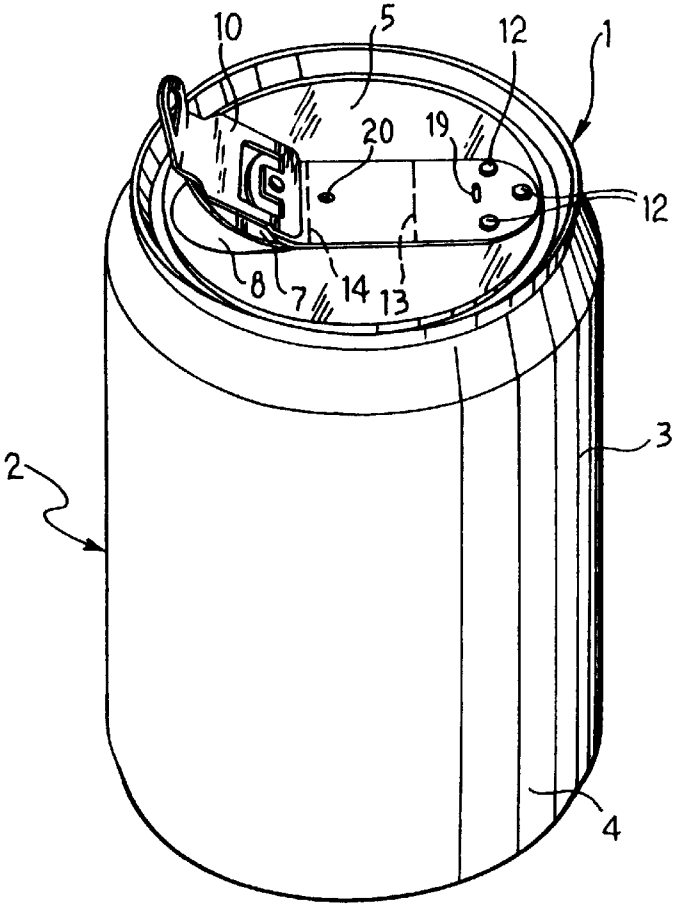
Figure 5:
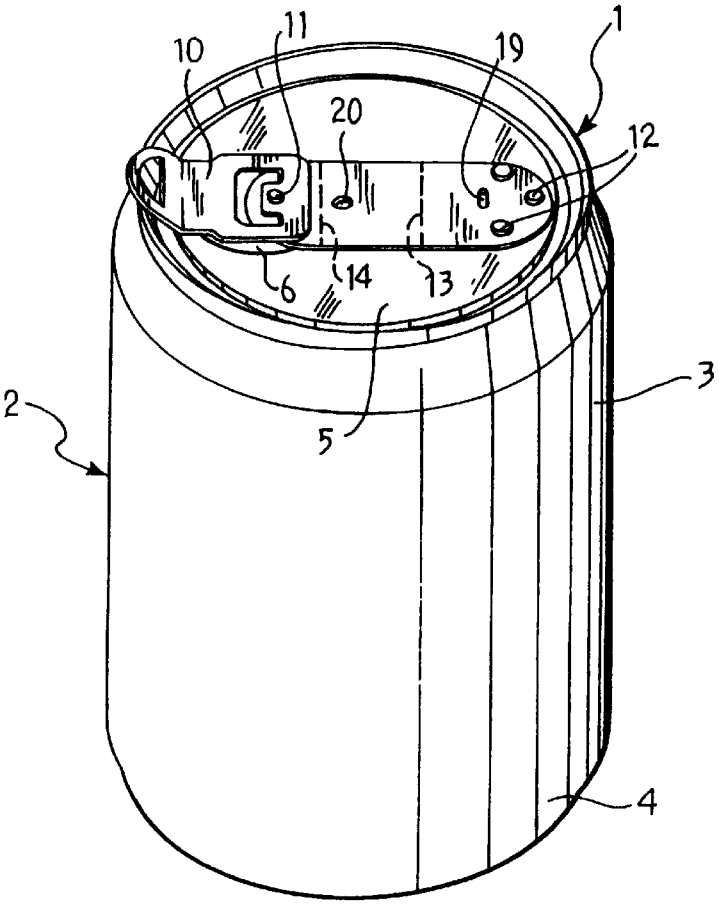
Figure 8:
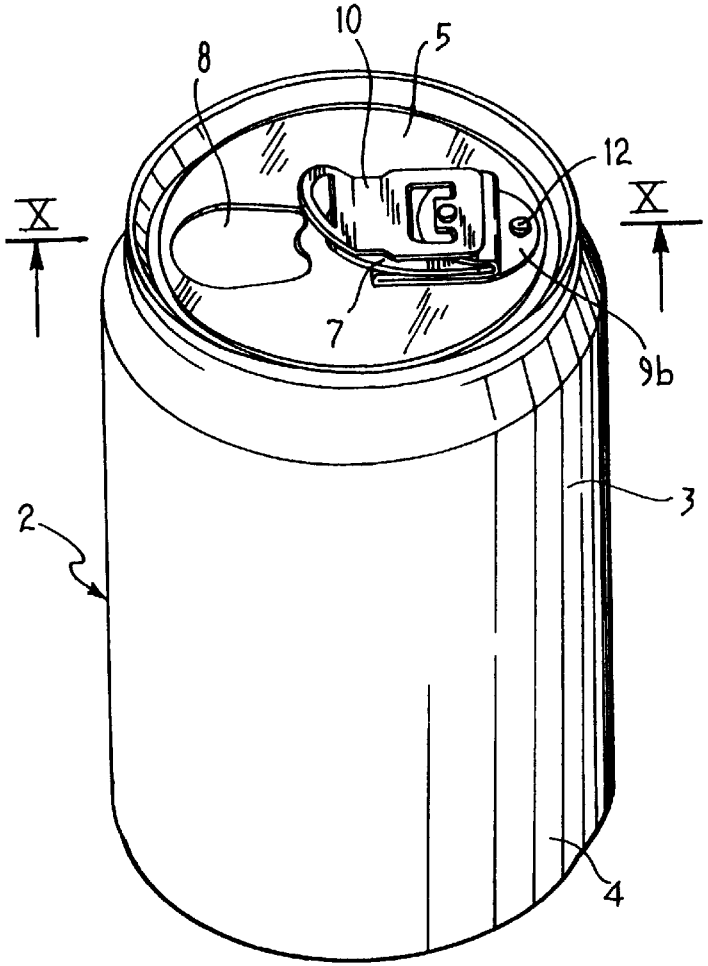
Figure 7:
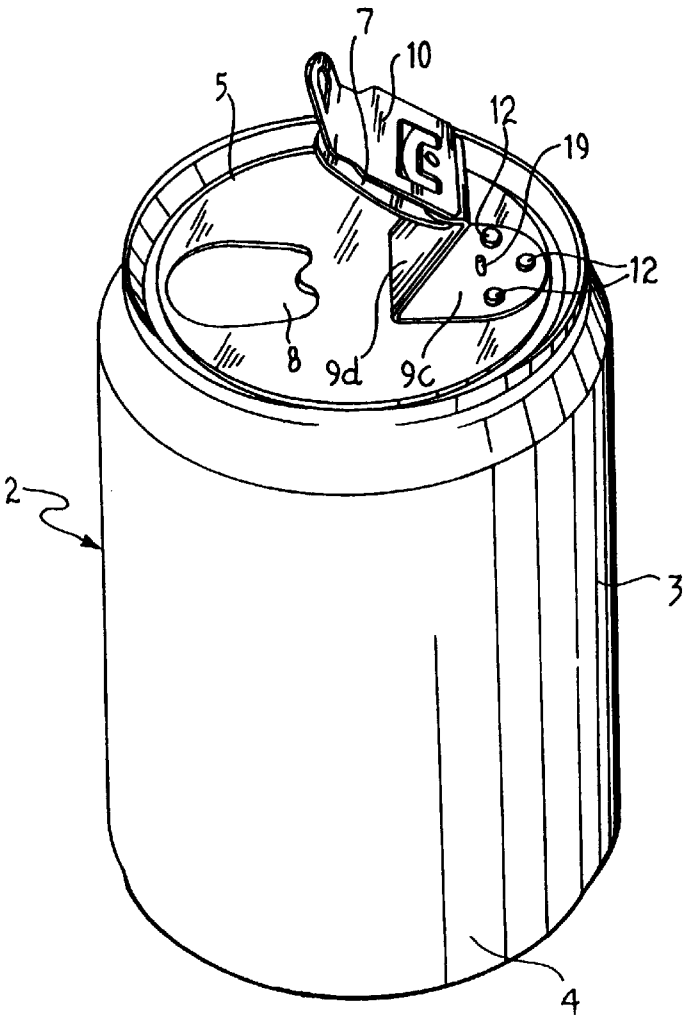
Figure 9:
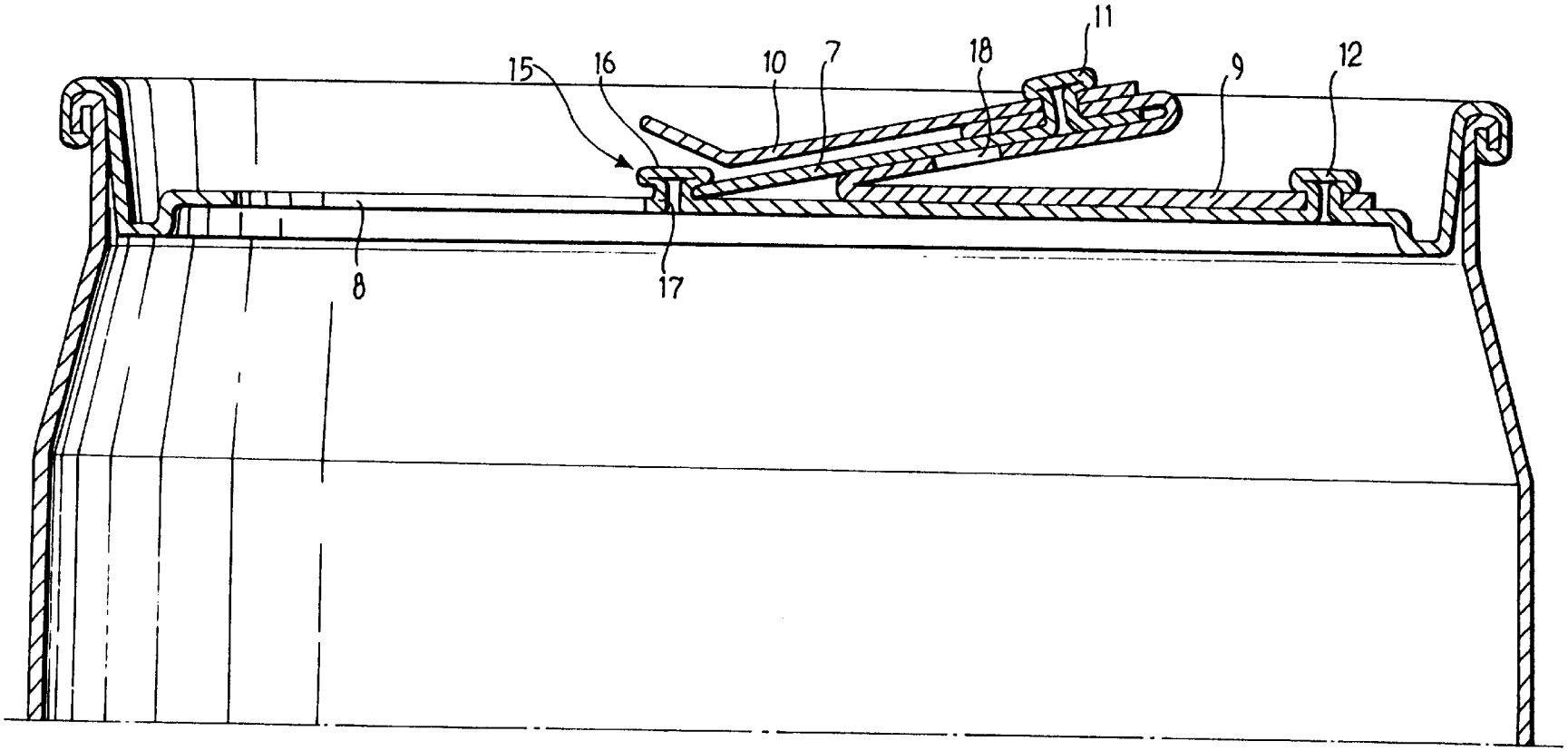
Figure 10:
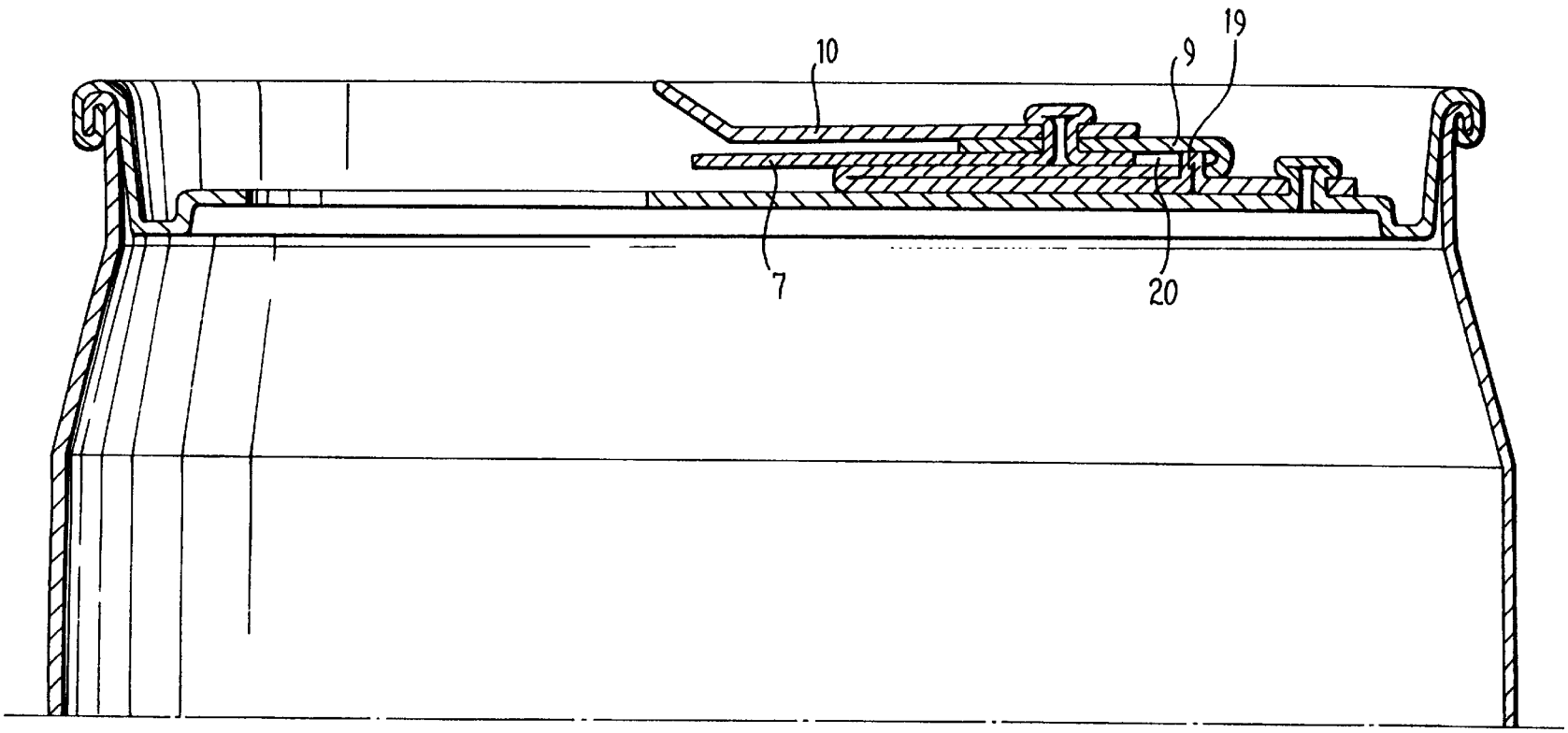

Further characteristics and advantages of the container according to the invention will become clear from the following detailed description given with reference to the appended drawings, provided purely by way of non-limiting example, in which:

FIGS. 1–4 are perspective views of a container according to the invention, shown in the closed configuration (FIG. 1), in two successive opening stages (FIGS. 2 and 3), and in the final open configuration of use (FIG. 4), respectively, FIGS. 5–8 are perspective views of a container according to another embodiment, which is also shown in the closed configuration (FIG. 5), in two successive opening stages (FIGS. 6–7), and in the final open configuration of use (FIG. 8), FIG. 9 is a section taken on the line IX—IX of FIG. 4, and FIG. 10 is a section taken on the line X—X of FIG. 8.

With reference to the drawings, a drinks container 1 according to the invention comprises a generally cylindrical receptacle 2 made, for example, of aluminium, steel or an alloy thereof. The side wall 3 and the base 4 of the receptacle are advantageously made in a single piece by the drawing technique.

A cover 5 also made, for example, of aluminium or an alloy thereof, is fixed sealingly to the top end of the receptacle by seaming. The inner faces of the wall of the container and of the cover may be coated with a film of polymeric material or varnish which is inert with respect to the product contained, in known manner.

A line of weakening 6 is formed on the outer face of the cover 5, for example, by partial incision (semi-blanking); the incision line 6 closes onto itself so as to define in the cover a lid 7 and a corresponding hole 8, adjacent the peripheral edge of the cover.

A flexible tongue, indicated 9, which extends longitudinally over the cover when the container is in the closed configuration, has its end 9*a* fixed to the portion of the cover defining the lid 7 and to an operating lever 10 an its other end 9*b* fixed to the cover adjacent its peripheral edge, spaced from the lid. The tongue is fixed to the lid and to the lever, for example, by means of a projection 11 which is integral with the lid and extends through a hole in the tongue 9 and a corresponding hole in the operating lever 10, and which is upset on the other side of these holes like a rivet (see FIGS. 9 and 10). Similarly, the other end 9*b* of the tongue is connected to the cover by means of one or more upset projections 12 formed integrally in the cover and extending through corresponding holes in the tongue.

When the container is in the closed configuration, the lever 10 advantageously covers and protects the line of weakening 6 so as to prevent the cover 5 from being torn or broken open along this line as a result of a load parallel to the axis of the container. It is intended that the tongue may be fixed to the cover and to the lid by any other means suitable for the purpose.

The tongue 9 is formed from a flexible plastics or metallic material, preferably from a plate of metal such as aluminium or an alloy thereof. The tongue preferably has one or more preformed bending lines, for example, a pair of bending lines 13, 14, spaced apart and arranged transverse the length of the tongue. The preformed bending lines enable the tongue to be bent onto itself as a result of the removal of the lid.

In the embodiment shown in FIGS. 1–4 and 9, the restraining means for keeping the tongue 9 in the bent configuration (FIGS. 4 and 9) comprise a mushroom-like projection 15 adjacent the hole 8 at the end facing towards the tongue. This projection 15, which has a flattened head 16 and a shank 17 is, for example, formed integrally with the cover by punching and upsetting. When the tongue is in the bent configuration, the front end of the lid which is detached from the cover can engage beneath the head 16 of the projection in the space between the head and the upper face of the cover and is restrained in this position against the resilient return forces of the tongue which tend to keep it in the extended configuration. In this embodiment, the tongue preferably has a through hole 18 positioned in a manner such that, when the container is in the closed configuration with the tongue extended over the cover, the head 16 of the projection extends through the hole, thus keeping the tongue in a substantially flat position.

Figure 1:
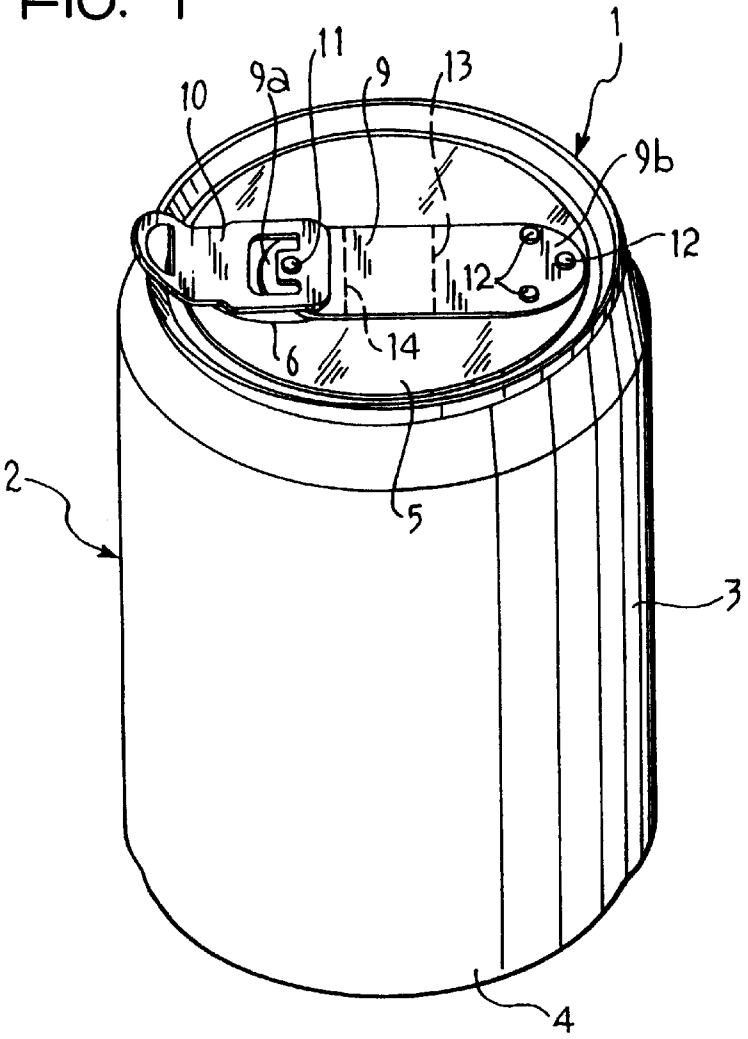

In this embodiment, in order to open the container and drink the drink contained therein, starting from the closed configuration of FIG. 1, the consumer operates the lever 10 to detach the lid 7 from the cover, after which he bends the tongue onto itself along the bending lines 13 and 14 and engages the front edge of the lid beneath the head 16 of the projection 15. The lid is thus kept connected to the container in a position in which it is disengaged from the hole 8.

In the embodiment shown in FIGS. 5–8 and 10, the restraining means comprise a pin 19, for example, integral with the tongue, produced by punching thereof, and disposed adjacent the end 9*b* of the tongue, and a through-hole 20 formed in the tongue and arranged in a manner such that, as a result of the bending of the tongue onto itself, it is in a position facing the pin 19 which can thus be inserted in the hole to restrain the tongue in the bent configuration. In this embodiment, the resilient return force of the tongue which tends to bring it back to the extended configuration, gives rise to an engagement between the pin 19 and the hole 20 which restrains the tongue in the bent configuration.

The invention is not intended to be limited to the specific restraining means described above but includes within its scope containers formed in accordance with the invention and also having other restraining means which enable the tongue and the associated lid to be restrained in a configuration in which they do not engage the hole 8 so that, after the container has been opened, the drink contained therein cannot come into contact with the upper face of the lid and the consumer's lips cannot come into contact with the sharp edges of the lid.

Thus, for example, coupling means of complementary shape may be provided in regions of the tongue which are superimposed on one another as a result of its bending; for example, a shaped projection (not shown) or a punching may be provided in a portion 9*c* (FIG. 3) of the upper face of the tongue for engaging a complementary recess formed in the upper face of an adjacent portion 9*d* (FIG. 3) of the tongue; likewise, a recess in the lower face of the portion 9*d* may engage a complementary projection projecting from the lower face of the lid 7.

Moreover, the opening device described above with reference to a specific container, constituted in the case in question by a drinks can, is also intended to be usable on any other container.

What is claimed is:

1. A container, particularly for drinks, comprising an end wall (5) in which a closed line of weakening (6) is formed defining the outline of a lid (7) and of a corresponding hole (8), and a lever (10) associated with the lid (7) and operable manually in order to tear the wall (5) along the line of weakening (6) and remove the lid (7) from the end wall, the container comprising a flexible tongue (9) which normally bears on the outer face of the end wall (5) and having one end (9*a*) fixed to the lever (10) and to the lid (7) and the other end (9*b*) fixed to the outer face of the end wall (5) of the container, spaced from the lid, and in which, as a result of the manual removal of the lid from the end wall, the tongue (9) can adopt a bent configuration in which the associated lid is in a position of disengagement from the hole (8), restraining means (15; 19, 20) being provided for keeping the tongue in the bent configuration, wherein the tongue has at least two preformed bending lines (13, 14) defining a first section connected to the end wall (5), a second section connected to the lever (10) and an intermediate section disposed between the first and the second section, characterised in that said preformed bending lines (13, 14) are arranged in such a manner that, in the bent configuration of the tongue (9) the intermediate section lies between the first and the second section.

2. A container according to claim 1, in which the flexible tongue is constituted by a metal plate.

3. A container according to claim 1, in which the restraining means comprise a mushroom-shaped projection (15) projecting from the outer face of the end wall (5) and having a head (16) for engaging an end of the lid (7) associated with the tongue (9) when the tongue is in the bent configuration.

4. A container according to claim 1, in which the restraining means comprise a pin (19) projecting from the tongue and a hole (20) formed in the tongue for engaging the pin when the tongue is in the bent configuration.

5. A container according to claim 1, in which the end (9*a*) of the tongue is fixed to the lever (10) and to the lid (7) by means of an upset projection integral with the lid.

6. A container according to claim 1, in which the end (9*b*) of the tongue is connected to the end wall (5) by means of at least one upset projection (12) integral with the end wall.

* * * * *